US007281524B2

(12) United States Patent
Braun

(10) Patent No.: US 7,281,524 B2
(45) Date of Patent: Oct. 16, 2007

(54) DEVICE FOR DELIVERING FUEL FROM A RESERVOIR TO AN INTERNAL COMBUSTION ENGINE

(75) Inventor: Hans-Peter Braun, Renfrizhausen (DE)

(73) Assignee: Robert Bosch GmbH, Stuttgart (DE)

( * ) Notice: Subject to any disclaimer, the term of this patent is extended or adjusted under 35 U.S.C. 154(b) by 173 days.

(21) Appl. No.: 10/560,903

(22) PCT Filed: May 5, 2004

(86) PCT No.: PCT/DE2004/000946

§ 371 (c)(1),
(2), (4) Date: Dec. 16, 2005

(87) PCT Pub. No.: WO2005/001277

PCT Pub. Date: Jan. 6, 2005

(65) Prior Publication Data

US 2007/0089714 A1 Apr. 26, 2007

(51) Int. Cl.
*F02M 37/02* (2006.01)
*F04B 23/14* (2006.01)

(52) U.S. Cl. ..... 123/510; 123/514; 470/79

(58) Field of Classification Search ..... 123/510, 123/511, 514; 417/76, 77, 79
See application file for complete search history.

(56) References Cited

U.S. PATENT DOCUMENTS 6,234,151 B1 * 5/2001 Eck ..... 123/514
6,474,310 B2 * 11/2002 Joos et al. ..... 123/514

FOREIGN PATENT DOCUMENTS

| | | |
|---|---|---|
| DE | 195 04 217 A1 | 8/1996 |
| EP | 1 433 949 A2 | 6/2004 |
| FR | 2 727 159 A1 | 5/1996 |
| JP | 62-214263 | 9/1987 |

* cited by examiner

*Primary Examiner*—Stephen K. Cronin
*Assistant Examiner*—Arnold Castro
(74) *Attorney, Agent, or Firm*—Ronald E. Greigg

(57) ABSTRACT

A fuel delivery device in which a preliminary filter and a throttle are provided in a drive line of a suction jet pump. The throttle is integrally formed with or connected to a preliminary filter to thereby reduce the manufacturing costs and simplify installation.

10 Claims, 3 Drawing Sheets

DEVICE FOR DELIVERING FUEL FROM A RESERVOIR TO AN INTERNAL COMBUSTION ENGINE

CROSS-REFERENCE TO RELATED APPLICATIONS

This application is a 35 USC 371 application of PCT/DE 2004/000946 filed on May 5, 2004.

BACKGROUND OF THE INVENTION

1. Field of the Invention

The present invention is directed to an improved fuel delivery device for delivering fuel from a storage tank to an internal combustion engine of a motor vehicle.

2. Brief Description of the Prior Art

The unpublished German patent application 103 03 390 has already proposed a fuel delivery device in which a preliminary filter and throttle are provided separately in a drive line of a suction jet pump. It is complex and expensive to install the preliminary filter and throttle separately in the drive line.

DE 195 04 217 A1 has disclosed a fuel delivery device with a drive line that is connected to the pressure side and contains a throttle to limit the flow. Dirt particles from the fuel and from the device can clog the throttle and cause the vehicle to break down.

SUMMARY AND ADVANTAGES OF THE INVENTION

The device according to the present invention has the advantage over the prior art of reduced manufacturing costs and a simplified installation of the preliminary filter and throttle into the drive line by virtue of the fact that the throttle is integrally connected to a preliminary filter.

Advantageous modifications and improvements of the device disclosed in the main claim are possible by means of the measures taken in the dependent claims.

Advantageous modifications and improvements of the device are disclosed. It is particularly advantageous if the throttle with the preliminary filter is manufactured by means of injection molding since this is a particularly inexpensive manufacturing process.

It is very advantageous if the throttle with the preliminary filter is press-fitted, clipped, glued, or welded into the drive line since these are particularly simple kinds of installation.

In one advantageous embodiment, the throttle has a throttle opening with an area, which, when embodied in a circular form, is comprised of a diameter of 0.6 to 1 mm, and the preliminary filter has filter openings; the area of a filter opening is less than the area of the throttle opening. This assures that all dirt particles that could clog the throttle opening are filtered out upstream of the throttle opening.

It is also advantageous if the preliminary filter is embodied as a filter cup with a filter bottom and a circumferential wall; filter openings are provided in the filter bottom and/or in the circumferential wall since this produces a filter area that is as large as possible and is not susceptible to clogging.

It is also advantageous if the filter cup tapers in the flow direction since this accelerates the flow.

Moreover, it is advantageous if the throttle is embodied in the form of a cap that contains a throttle opening since this constitutes a particularly simple embodiment variant.

It is advantageous if the filter cup and the cap are connected to each other by connecting pieces since the connecting pieces afford a sufficient spacing between the preliminary filter and the throttle to allow the fuel flowing both via the filter bottom and via the circumferential wall to travel to the throttle opening in favorably flowing fashion.

It is also advantageous if a shoulder of the preliminary filter and a collar of the throttle rest flush against a drive line wall inside the drive line since this prevents fuel from leaking past the preliminary filter and the throttle.

BRIEF DESCRIPTION OF THE DRAWINGS

An exemplary embodiment of the present invention is described herein below, in conjunction with the drawings, in which.

DESCRIPTION OF THE PREFERRED EMBODIMENT

Figure 1:
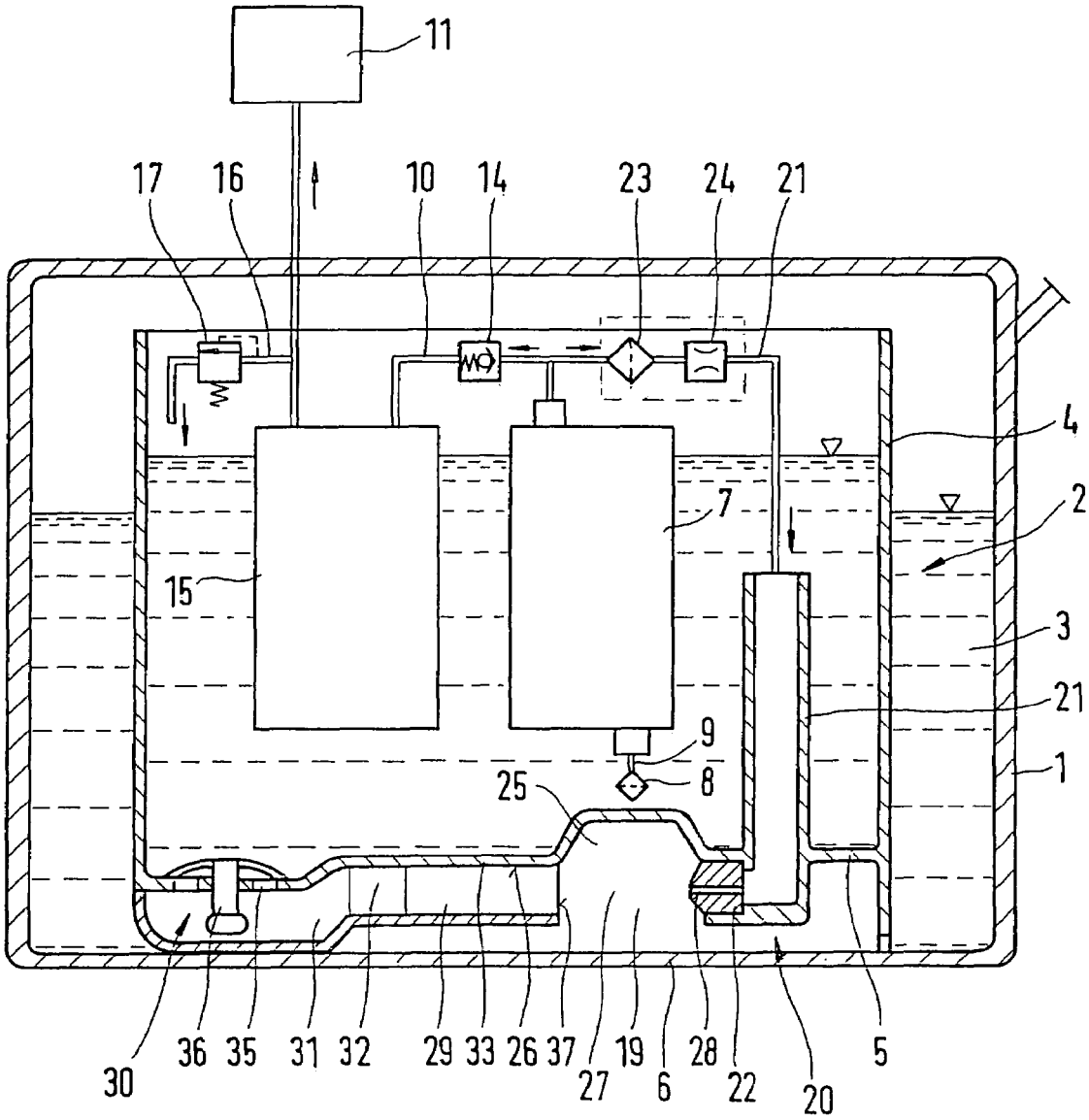
FIG. 1 shows a simplified section through a fuel delivery device according to the present invention.

FIG. 1 shows a device according to the present invention for delivering fuel from a reservoir to an internal combustion engine of a motor vehicle. The device has a fuel delivery module 2 contained inside a storage tank 1. For example, a fuel 3 is stored in the storage tank 1.

The fuel delivery module 2 is comprised of a for example cup-shaped storage reservoir 4, which contains a fuel supply pump 7 that draws fuel from the storage reservoir 4, for example via a filter 8 and an intake line 9, and delivers it at an increased pressure to an internal combustion engine 11 via a pressure line 10. The storage reservoir 4 stores a sufficient supply of fuel to permit the fuel supply pump 7 to supply enough fuel to the internal combustion engine 11 even when no fuel is being fed into the storage reservoir 4, for example during cornering and the accompanying sloshing of the fuel in the storage tank 1. The storage reservoir 4 is situated with its cup bottom 5 close to a tank bottom 6 of the storage tank 1.

For example, the fuel supply pump 7 is a jet pump that is electrically driven by an actuator, for example an armature of an electric motor.

The filter 8 protects the device downstream of the filter 8 from coarse dirt particles contained in the fuel.

For example, the pressure line 10 contains a check valve 14 and, downstream of the check valve 14, a main filter 15 that filters out fine dirt particles contained in the fuel. When the fuel supply pump 7 is switched off, the check valve 14 prevents fuel from flowing out of the pressure line 10 downstream of the check valve 14 through the pressure line toward the section upstream of the check valve 14, through the fuel supply pump 7, the intake line 9, and the filter 8, and back into the storage reservoir 4. In this manner, the pressure that the fuel supply pump 7 has built up in the pressure line 10 is maintained for a certain amount of time, even when the fuel supply pump 7 is switched off.

Downstream of the main filter 15, the pressure line 10 is provided with a branch line 16 that feeds into the storage reservoir 4. The branch line 16 contains a pressure control valve 17. If the pressure in the pressure line 10 and therefore in the branch line 16 exceeds a predetermined pressure, the pressure control valve 17 opens and permits fuel to flow out of the pressure line 10 via the branch line 16 and into the storage reservoir 4. As a result, the pressure in the pressure line 10 falls back below the predetermined pressure so that the pressure control valve 17 closes again and does not permit any more fuel to flow into the storage reservoir 4 via the branch line 16. The pressure control valve 17 regulates the pressure in the pressure line 10 downstream of the check valve 14 to a constant value.

To prevent the storage reservoir 4 from being emptied by the fuel supply pump 7, a replenishing supply of fuel must continuously flow into the storage reservoir 4 from the storage tank 1. For this purpose, the storage reservoir 4 is provided with at least one suction jet pump 20 that delivers fuel from the storage tank 1 into the storage reservoir 4.

A suction jet pump is known, for example, from DE 198 56 298 C1, whose content is expressly considered to be included in the disclosure of the present application by reference.

From the pressure line 10, in the region downstream of the fuel supply pump 7 and upstream of the check valve 14, a drive line 21 leads to a nozzle 22 of the suction jet pump 20.

The drive line 21 contains a preliminary filter 23 and, downstream of the preliminary filter 23, a throttle 24. The preliminary filter 23 protects the throttle 24 from dirt particles that can clog the throttle 24. The throttle 24 limits the volumetric flow that flows through the drive line 21. According to the present invention, the throttle 24 is of one piece with the preliminary filter 23. The preliminary filter 23 is thus integrated into the throttle 24.

The nozzle 22 is positioned at an end of the drive line 21 oriented toward the storage tank 1, for example is clamped, clipped, glued, or welded into the drive line 21. The nozzle 22 has a nozzle opening 28 feeding into a suction chamber 27. The suction chamber 27 is formed by a bulge 25 in the cup bottom 5 and is connected to the storage tank 1 via an intake opening 19. The suction chamber 27 is delimited by the cup bottom 5, the nozzle 22, the intake opening 19, and a mixing conduit 29, which is provided downstream of the suction chamber 27 and extends from the suction chamber 27, for example horizontally, in the same direction of the tank bottom 6. A suction jet pump with a horizontally extending mixing conduit is also referred to as a horizontal suction jet pump; on the other hand, a suction jet pump with a vertically extending mixing conduit is referred to as a vertical suction jet pump. At an end of the mixing conduit 29 oriented toward the storage reservoir 4, the mixing conduit 29 feeds into the storage reservoir 4 via an additional check valve, for example an umbrella valve 30, which closes in the direction toward the storage tank 1. At the end oriented toward the storage reservoir 4, for example, the mixing conduit 29 has a diffuser section 31 in which the mixing conduit 29 expands in the flow direction, for example transverse to the plane of the drawing.

During operation of the fuel supply pump 7, fuel traveling via the pressure line 10, the drive line 21, and the nozzle opening 28 of the nozzle 22 is injected into the suction chamber 27 as a motive jet. As it enters the suction chamber 27, the motive jet entrains fuel in the flow direction in an intrinsically known fashion so that a vacuum is produced in the suction chamber 27, which draws a replenishing supply of additional fuel from the storage tank 1 into the suction chamber 27. The fuel of the motive jet and the fuel entrained by it travel through an inlet opening 37 of the mixing conduit 29, into the mixing conduit 29, and via a valve opening 35 of the umbrella valve 30, into the storage reservoir 4.

Figure 2:
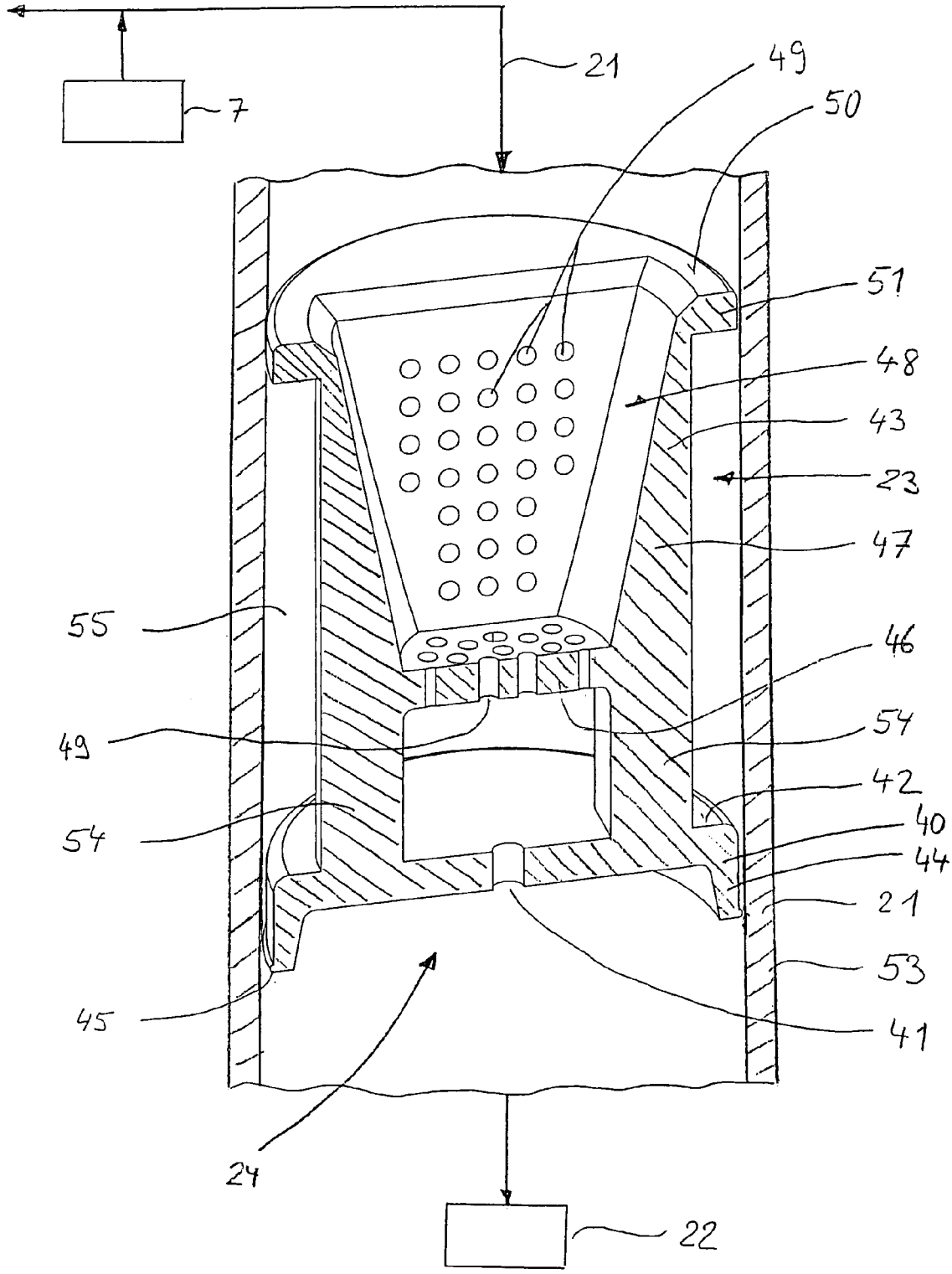
FIG. 2 shows a section through a throttle with an integrated preliminary filter.
Figure 3:
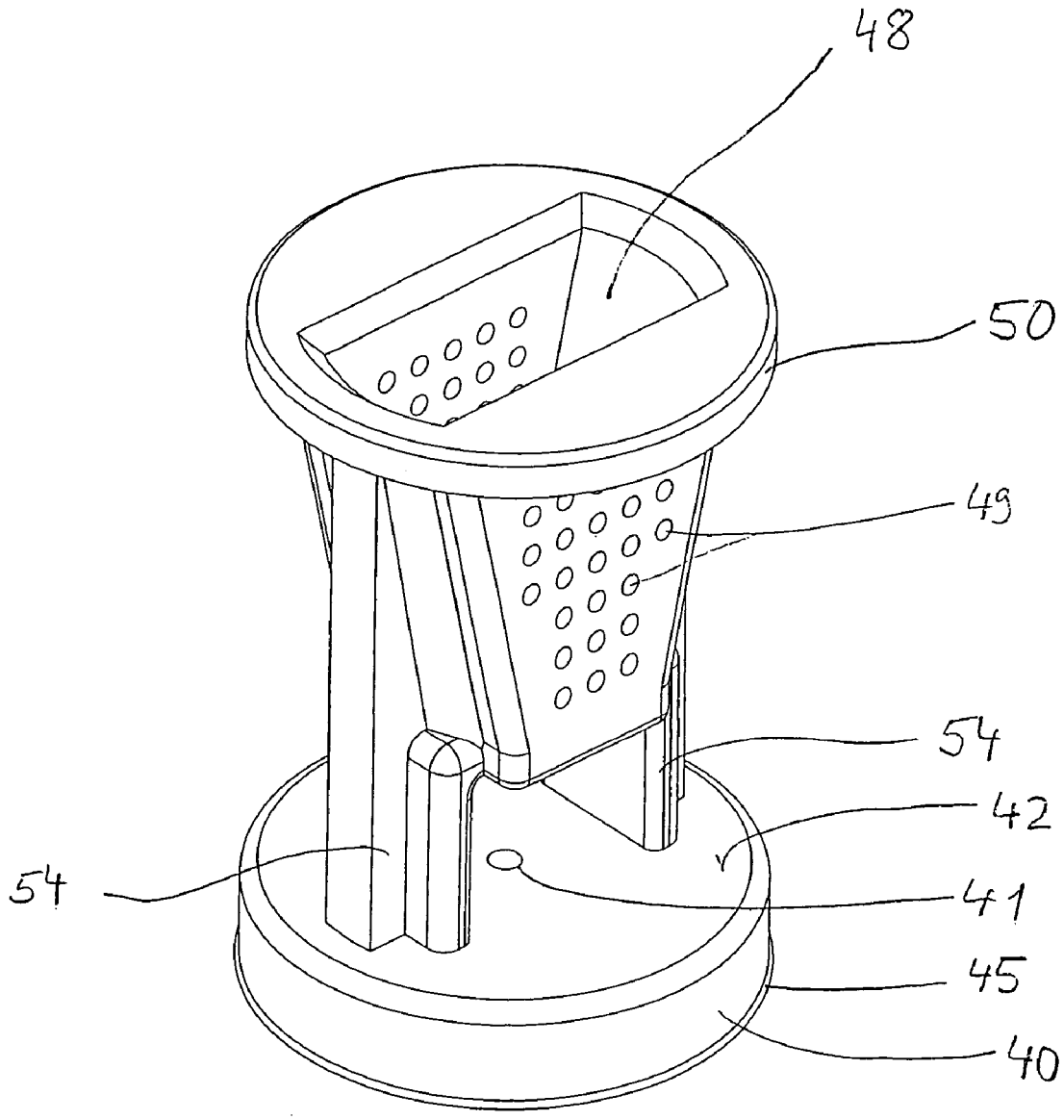
FIG. 3 is a three-dimensional view of the exemplary embodiment according to FIG. 2.

In the device according to FIGS. 2 and 3 the fuel delivery module 2 is comprised of a for example cup-shaped storage reservoir 4, which contains a fuel supply pump 7 that draws fuel from the storage reservoir 4, for example via a filter 8 and an intake line 9, and delivers it at an increased pressure to an internal combustion engine 11 via a pressure line 10. The storage reservoir 4 stores a sufficient supply of fuel to permit the fuel supply pump 7 to supply enough fuel to the internal combustion engine 11 even when no fuel is being fed into the storage reservoir 4, for example during cornering and the accompanying sloshing of the fuel in the storage tank 1. The storage reservoir 4 is situated with its cup bottom 5 close to a tank bottom 6 of the storage tank 1.

At its circumference, the cap 40 has an annular engaging collar 44 at its end oriented toward the nozzle 22. The preliminary filter, which is embodied for example as a cup-shaped filter cup 43, is located at the top 42 of the cap 40 oriented toward the fuel supply pump 7. The filter cup 43 is comprised of a filter bottom 46 and a circumferential wall 47; the filter bottom 46 and a circumferential wall 47 enclose a filter chamber 48 that is open at the end oriented away from the filter bottom 46 and is flow connected to the drive line 21. The filter bottom 46 and the circumferential wall 47 are embodied as straight, for example, but can also bulge outward. The filter bottom 46 and the cap 40 are oriented toward each other; for example, the filter bottom 46 is parallel to the cap 40 or can also be inclined in relation to the cap 40. For example, the filter cup 43 can be embodied as square, triangular, rectangular, polygonal, circular, or oval and tapers, for example, in the flow direction. Arbitrarily shaped filter openings 49 are provided in the filter bottom 46 andlor in the circumferential wall 47 of the filter cup 43; a filter opening 49 has a smaller area than the throttle opening 41. This assures that all dirt particles that could clog the throttle opening 41 are filtered out in the preliminary filter 23 upstream of the throttle opening 41. When they are embodied in a circular form, for example, the filter openings 49 have a diameter of 0.5 mm. However, it is also expressly possible for there to be circular filter openings 49 with a diameter other than 0.5 mm. The filter openings 49 provided in the filter cup 43 constitute a large filter area so that the preliminary filter 23 is not susceptible to clogging. If dirt particles become lodged in or against a filter opening 49, thus clogging it, there are still many other filter openings 49 through which the fuel can pass. At a cup rim 50 of the filter cup 43 oriented away from the filter bottom 46, a disk-shaped shoulder 51 is provided that protrudes radially outward until it touches a drive line wall 53 of the drive line 21. The preliminary filter 23 rests flush against the drive line wall 53 of the drive line 21 with its shoulder 51, and the throttle 24 rests flush against the drive line wall 53 of the drive line 21 with the collar 44 of the cap 40 or with a sealing lip 45 extending in a ring around the collar 44, thus preventing a leakage that bypasses the preliminary filter 23 and the throttle 24 in the form of a bypass flow.

The circumferential wall 47 is spaced radially apart from the drive line wall 53. The cap 40 of the throttle 24 and the cup-shaped preliminary filter 23 are integrally connected to each other, for example by means of two connecting pieces 54. The connecting pieces 54 extend upward from the top 42 of the cap 40, either perpendicularly or inclined at an angle and are connected, for example, to the circumferential wall 47 and/or the filter bottom 46. The connecting pieces 54 space the filter cup 43 apart from the cap 40 with the throttle opening 41. The shoulder 51, the top 42 of the cap 40, the drive line wall 53, and the circumferential wall 47 enclose a storage chamber 55. The filter chamber 48 and the storage chamber 55 are flow connected to each other via the filter openings 49.

The fuel in the drive line 21 upstream of the preliminary filter 23 flows into the filter chamber 48, through the filter openings 49 in the filter bottom 46 and/or in the circumferential wall 47, and into the storage chamber 55. In the storage chamber 55, the fuel flows toward the throttle opening 41. The fuel flowing through the filter openings 49 of the circumferential wall 47 has a different flow path to the throttle opening 41 than the fuel flowing through the filter openings 49 in the filter bottom 46. In order for the fuel flowing through the filter openings 49 of the circumferential wall 47 to flow to the throttle opening 41 in a favorably flowing manner, the distance selected for the spacing between the filter bottom 46 and the cap 40 must be of sufficient magnitude. The flow upstream of the throttle opening 41 is constricted and travels through the throttle opening 41 in the form of a jet in the direction of the nozzle 22. The throttle opening 41 of the throttle 24 functions as a flow limiter. The diameter of the throttle opening 41 is appropriately embodied to set the volumetric flow traveling through the drive line 21 and the throttle opening 41.

The throttle 24 with the preliminary filter 23 is manufactured, for example, by means of injection molding. The throttle 24 can also be integrally connected to the preliminary filter 23 by means of gluing or welding. Embodying the throttle 24 and the preliminary filter 23 of one integral component reduces the manufacturing costs of both parts and simplifies installation. The preliminary filter 23 upstream of the throttle 24 filters out dirt particles from the fuel in the drive line 21 as well as dirt particles generated during the manufacturing process of the device so that the throttle 24 does not become clogged. A clogged throttle 24 would prevent the suction jet pump 20 from supplying any more fuel into the storage reservoir 4 so that the level in the storage reservoir 4 would decrease after a certain amount of time and the fuel pump 7 would no longer be supplied with a sufficient amount of fuel. Particularly with low levels of fuel in the storage tank 1, this would cause the vehicle to break down.

The throttle 24 with the integrated preliminary filter 23 is mounted in the drive line 21 as a separate component, in particular one made of plastic. In this way, the throttle opening 41 can be manufactured with a high degree of precision and without disadvantageous cutting burrs. Structural changes for adapting to the volumetric flow traveling through the drive line 21 need only be carried out in the separate throttle 24 and not in the fuel delivery module 2 itself.

The throttle 24 provided upstream of the nozzle 22 achieves a multi-stage pressure drop so that the throttle opening 41 of the throttle 24 and the nozzle opening 28 of the nozzle 22 can be selected to be larger than in a one-stage pressure drop that occurs only at the nozzle 22 without a throttle 24. This makes it possible to manufacture the nozzle 22 and the throttle 24 less expensively by means of injection molding and reduces the amount of flow noise generated.

The throttle 24 with the preliminary filter 23 is situated, for example, close to the pressure line 10 in a horizontally oriented suction jet pump 20, and is situated, for example, close to the nozzle 22 in a vertically oriented suction jet pump 20.

The foregoing relates to preferred exemplary embodiments of the invention, it being understood that other variants and embodiments thereof are possible within the spirit and scope of the invention, the latter being defined by the appended claims.

The invention claimed is:

1. In a device for delivering fuel from a storage tank to an internal combustion engine of a motor vehicle, having a throttle provided in a drive line for a suction jet pump, the improvement comprising a preliminary filter integrally connected to the throttle.

2. The device according to claim 1, wherein the throttle with the preliminary filter is manufactured by means of injection molding.

3. The device according to claim 1, wherein the throttle with the preliminary filter is press-fitted, clipped, glued, or welded into the drive line.

4. The device according to claim 1, wherein the throttle has a throttle opening with an area that, in a circular embodiment, results from a diameter of 0.6 to 1 mm.

5. The device according to claim 1, wherein the preliminary filter has filter openings and the area of a filter opening is smaller than the area of a throttle opening of the throttle.

6. The device according to claim 1, wherein the preliminary filter is embodied in the form of a filter cup, which has a filter bottom and a circumference wall, and the filter bottom and/or the circumferential wall are provided with filter openings.

7. The device according to claim 6, wherein the filter cup tapers in the flow direction.

8. The device according to claim 1, wherein the throttle is embodied in the form of a cap that contains a throttle opening.

9. The device according to claim 6, wherein the throttle is embodied in the form of a cap that contains a throttle opening and wherein the filter cup and the cap are connected to each other by connecting pieces.

10. The device according to claim 1, wherein a shoulder of the preliminary filter and a collar of the throttle rest flush against the drive line wall of the drive line.

* * * * *

UNITED STATES PATENT AND TRADEMARK OFFICE

CERTIFICATE OF CORRECTION

PATENT NO. : 7,281,524 B2
APPLICATION NO. : 10/560903
DATED : October 16, 2007
INVENTOR(S) : Hans-Peter Braun It is certified that error appears in the above-identified patent and that said Letters Patent is hereby corrected as shown below:

Title page,

Item (30) should read as follows:

(30) Foreign Application Priority Data

June 30, 2003 (DE) ..... 103 29 268

Signed and Sealed this

Twenty-seventh Day of November, 2007

JON W. DUDAS
*Director of the United States Patent and Trademark Office*